United States Patent [19]

Tancs

[11] Patent Number: 4,841,890

[45] Date of Patent: Jun. 27, 1989

[54] THREAD BREAK INDICATING DEVICE FOR SEWING MACHINES USING A PHOTO AMPLIFIER

[75] Inventor: Tibor L. Tancs, Roselle Park, N.J.

[73] Assignee: SSMC Inc., Fairfield, N.J.

[21] Appl. No.: 197,372

[22] Filed: May 23, 1988

[51] Int. Cl.[4] ..... D05B 69/36

[52] U.S. Cl. ..... 112/273; 112/278

[58] Field of Search ..... 112/278, 273; 65/2

[56] References Cited

U.S. PATENT DOCUMENTS

| | | | |
|---|---|---|---|
| 3,174,046 | 3/1965 | Lindermann et al. | 112/273 X |
| 3,599,586 | 8/1971 | Newman | 112/278 |
| 4,250,825 | 2/1981 | Kamiyama | 112/278 |
| 4,342,580 | 8/1982 | Roberson | 65/2 |
| 4,426,948 | 1/1984 | Olasz et al. | 112/273 |
| 4,602,582 | 7/1986 | Rawson | 112/273 |
| 4,691,647 | 9/1987 | von Stein | 112/273 |

*Primary Examiner*—Andrew M. Falik

[57] ABSTRACT

A sewing machine thread break detector using a photo amplifier in which thread to be monitored is guided relatively to a light beam so that thread movement will vary transmitted light. An electronic circuit signals thread breakage when uniformity of the transmitted light beam indicates thread motion has ceased during sewing machine operation.

5 Claims, 1 Drawing Sheet

THREAD BREAK INDICATING DEVICE FOR SEWING MACHINES USING A PHOTO AMPLIFIER

DESCRIPTION

1. Field of the Invention

This invention relates to a device for monitoring the condition of threads being manipulated into stitches by a sewing machine, and more particularly, to a device for signaling the event of thread breakage.

2. Background of the Invention

There are numerous occasions during operator control of a sewing machine when the attention of the operator is primarily focused on work fabric positioning and guiding so that sewing machine operation might be continued for an appreciable period after thread breakage and before the resulting absence of formed stitches would be noticed. In automatic industrial sewing installations, for instance in robotic sewing units, unnoticed thread breakage can be far more disruptive of efficiency and productivity.

Prior thread break indicators for sewing machines are of two basic types; the first, as disclosed for instance, U.S. Pat. No. 4,170,951, Oct. 16, 1979 of L. Dobrjanskyj uses a tensiometer to apply a resistance to movement of a portion of the sewing thread which is manipulated during sewing so as to measure and respond to the resulting tension in the thread. A second type of known thread break indicator as disclosed in U.S. Pat. No. 3,352,267, Nov. 14, 1967 of Brandriff et al senses movement of the thread by harnessing the thread to drive a sensing device such as a spoked wheel of which the motion may be monitored.

These known thread break detectors suffer from a number of disadvantages foremost of which is that they all apply tension to the sewing thread which can in itself cause or contribute to thread breakage. Moreover, the known thread break detectors require the presence of costly mechanical devices which are subject to wear and adjustment and which are required to be located on a sewing machine in restricted areas critical to thread manipulation during sewing.

SUMMARY OF THE INVENTION

It is an object of this invention to provide a sewing machine thread break indicator which does not impose any tension nor apply any stress-creating load on the thread being monitored.

It is also an object of this invention to provide a thread break indicator for a sewing machine which does not require any mechanically operative device engageable or in contact with the thread to be monitored.

A further object of this invention is to provide a thread break indicator which does not require any space to be occupied in the vicinity of those instrumentalities of the sewing machine for manipulating the thread during sewing.

These objects of this invention are attained by an arrangement which monitors the influence which unbroken sewing thread exerts upon a light beam during sewing machine operation.

DESCRIPTION OF THE DRAWINGS

With the above and additional objects and advantages in view, as will hereinafter appear, this invention comprises the devices, combinations, and arrangements of parts hereinafter described and illustrated in a preferred embodiment shown in the accompanying drawings in which.

DETAILED DESCRIPTION OF THE PREFERRED EMBODIMENT

The accompanying drawings illustrate a preferred embodiment of this invention particularly adapted for use with an operator controlled sewing machine.

Figure 1:
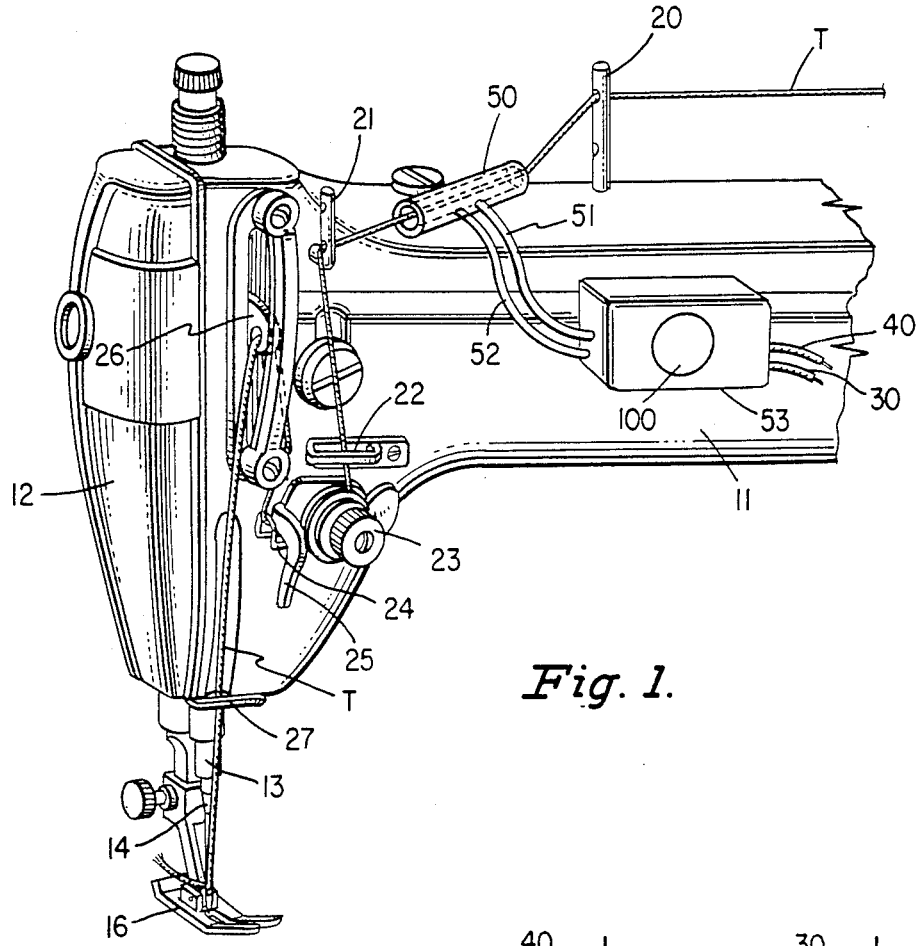
FIG. 1 is a front perspective view of the bracket arm portion of a sewing machine having this invention applied thereto.

Referring to the drawings, FIG. 1 illustrates a portion of the bracket arm 11 of a typical sewing machine terminating in a sewing head 12. The sewing head supports an endwise reciprocating needle bar 13 to which an eye pointed needle 14 is secured. A downwardly biased presser bar 15 is also carried in the sewing head and fitted with a presser foot 16 for constraining work fabrics in the path of the needle.

In FIG. 1, the needle thread T is illustrated together with thread guiding, conditioning and manipulating instrumentalities for handling the needle thread in a stitch forming process. These instrumentalities include thread guides 20,21 and 22 for directing the needle thread T from a supply spool (not shown) to a thread tension device 23, with an associated check spring 24, a thread guide 25 accommodating the thread T from the check spring 24 and toward a thread take-up 26 and a thread guide 27 on the needle bar 13 from whence the thread is passed through the needle eye and to the stitched seam.

It will be understood that drive mechanism (not shown) is provided for operating the needle and needle thread take-up in a timed relationship appropriate to the type of stitch formation for which the sewing machine is designed. Since the thread break detector of this invention works equally well with lock stitch sewing machines or single or multiple thread chainstitch sewing machines, any known drive mechanism would be appropriate. Moreover, the electric power for operating the sewing machine may be applied to the drive mechanism either by way of a power transmitter which is typical for use with industrial type sewing machines, or by way of individual drive motor and operator influenced motor speed controller as is typical for use with domestic type sewing machines. The electric motor drive is not shown on the drawings since any known form may be employed with the present invention. The only requirement for satisfactory operation of the preferred form of this invention illustrated in the accompanying drawing is that a rectified DC signal be supplied to the thread break indicating control circuit on line 30 from whatever sewing machine drive motor control system is employed and whenever the motor is operatively connected and energized to drive the sewing machine.

Similarly a rectified DC source of electric power is required to be supplied on line 40 to the thread break indicating control circuit to power the electronic components thereof as will now be described.

As shown in FIG. 1 a thread guiding tube 50 is supported on the sewing machine bracket arm 11 preferrably in substantial alignment with a normal path of the thread T. The tube 50 through which the thread passes is formed with a highly polished light reflective interior surface opening onto which at right angles are a pair of light conducting pipes 51 and 52 which may be bound together as a single flexible unit and directed to a control package 53 secured anywhere on or near the sewing machine. For an operator controlled sewing machine it is preferable that the control package be arranged in view of the operator on top or in front of the bracket arm or machine frame.

Figure 2:
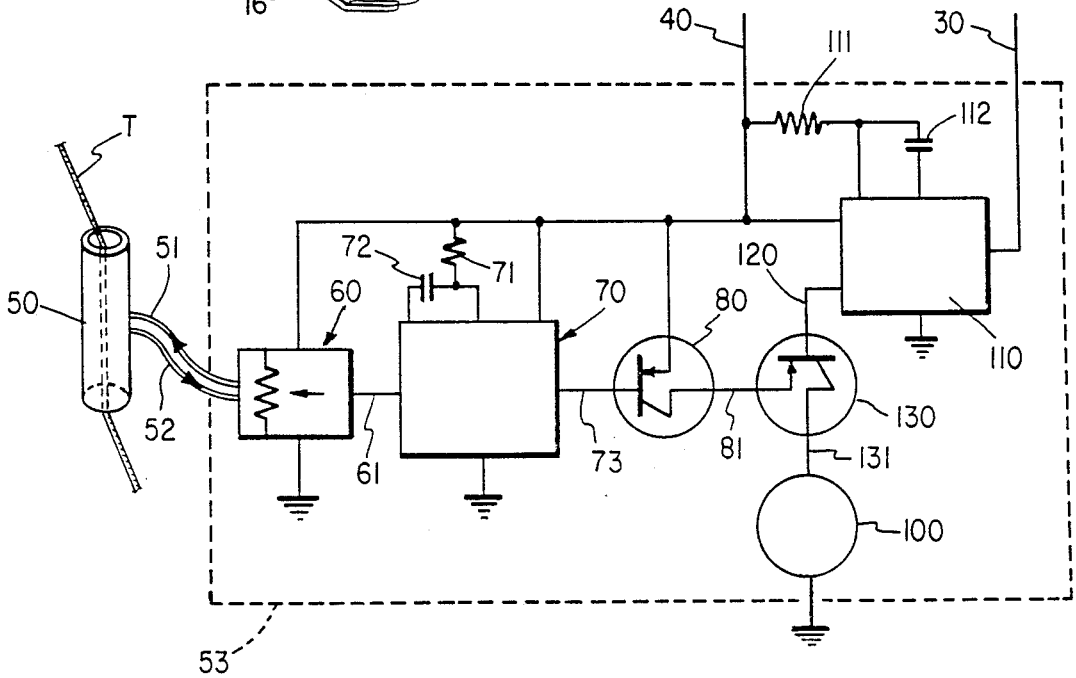
FIG. 2 is a schematic diagram, partially in block form of this invention.

As shown in the schematic diagram of FIG. 2, the control package 53 includes a photo generator and photo amplifier unit 60, which may be a unit FS-17 manufactured by KEYENCE or the equivalent, and includes preferrably an LED light source generating light which is transmitted by light pipe 51 to the interior of the thread accommodating tube 50. Reflected light from the tube interior is directed by light pipe 52 back to the photo amplifier unit 60 where it influences generation of an amplified signal on line 61.

The relationship between the thread guiding tube 50 and the light pipes 51 and 52 is of considerable importance to the effective operation of the subject thread break indicator. In addition to extending sufficiently far on each side of the juncture with the light pipes 51 and 52 to preclude interference by ambient light, the internal diameter of the thread guiding tube must be sufficiently larger than the diameters of the light pipes as to provide for a range of different positions of a sewing thread transversely of the tube and with respect to the light reflected between the light pipes. Such a range of possible positions provides for a varying influence of the thread on the intensity of light transmitted back through the light pipe 52 when motion of the thread occurs. In contrast, should thread motion within the tube cease, as when thread breakage occurs, whatever the influence upon transmitted light may be, it will remain substantially constant.

It will be appreciated that when there is uniformity in the reflected light transmitted by light pipe 52 back to the photo amplifier 60 there will be uniformity in the signal generated on line 61, and this condition of uniformity will exist during any period in which the thread T remains stationary as, for instance, in the event of thread breakage. Movement of the thread in the tube 50, however, will cause the reflected light to vary in intensity thus causing related variation in the amplified signal generated on line 61.

The line 61 is directed as input to a one-shot unit 70 which is preferably an RCA integrated unit CD 4538 including a control circuit with resistor 71 and capacitor 72 for influencing the time duration of the pulse of relatively high voltage delivered by the one-shot 70 on line 73 following each upward transition of the signal on line 61. In other words, with proper setting of the values of resistor 71 and capacitor 72 continued variation in the reflected light in tube 50 will result in continuous generation of a high voltage output on line 72 by the one-shot 70 while any period of uniformity of reflected light in the tube 50 will result in termination of the pulse output by the one-shot 70 and a resulting low voltage output on line 73.

A transistor 80 may be employed responsive to any low voltage signal on line 73 to conduct line current from line 40 into line 81.

Designated at 100 in FIGS. 1 and 2 is a signaling device which may be a signal lamp such as an LED or the like, or an audible signaling device. Line 81 is preferrably not connected directly to the signaling device 100 for the reason that it is preferable to prevent false signaling of thread breakage during periods when the sewing machine is not driven. To prevent such occurrance, the signal on line 30 from the sewing machine drive motor control which indicates sewing machine operation is directed to a one-shot 110 which may be of the same type as the one-shot 70 including a control circuit with a resistor 111 and a capacitor 112 so that after the initial transition upon each start of sewing machine drive to insure acceleration of the sewing machine stitch forming instrumentalities, the one-shot 110 will continuously deliver on line 120 a low voltage signal which is directed to a transistor 130 influencing transmission of power from line 81 to the signaling device 100 via line 131 only during periods of sewing machine operation.

For an operator controlled sewing machine, the embodiment of this invention illustrated in the accompanying drawings and described hereinabove will provide audible or visible warning of thread breakage whenever during sewing machine operation movement of needle thread from its supply ceases. Moreover, with the present invention the thread motion detector does not impose any tension on the thread which might cause or contribute to thread breakage, all portions of the detector are located remote from the critical thread take-up and tensioning instrumentalities of the sewing machine, and no wear prone mechanical devices are involved in the arrangement of the present invention.

For automated sewing machine installations in which the sewing machine is operated without operator attention, as in robotic units in which the sewing machine responds to computer control, a similar arrangement of the thread guiding tube 50 with light pipes 51 and 52 leading to a control package 53 may be employed. However, the control package 53 need not necessarily be located in a location conspicuous to a machine operator and the control package, moreover, need only include the photo emplifier unit 60 and the one-shot unit 70 shown in FIG. 2. The output line 73 from the one-shot 70 may be directed to the sewing machine controlling computer and rather than or in addition to providing an audible or visible sign 1, the computer may be programmed in any known fashion to interrupt sewing machine operation in the event that thread breakage is signalled on line 73 during sewing machine operation.

It is understood that the above described embodiments are merely illustrative of the application of the principles of this invention. Numerous other embodiments may be devised by those skilled in the art without departing from the spirit and scope of this invention, as defined by the appended claims.

I claim:

1. A sewing thread break indicator for a sewing machine comprising a photo amplifier delivering an output proportional to the intensity of light imput thereto, means for transmitting a beam of light to the imput of said photo amplifier, a guide for the sewing thread to be monitored, said guide defining a range of thread positions of varying influence on the intensity of said transmitted beam of light, and means responsive to uniformity in the output of said photo amplifier for signaling breakage of said sewing thread, said guide for the sewing thread including a thread accommodating tube with a polished light reflective interior, the internal diameter of said thread accommodating tube being sufficiently larger that said means for transmitting a beam of light to the imput of said photo amplifier as to define said range of thread positions of varying influence on said transmitted beam of light.

2. The indicator of claim 1 wherein said means for transmitting a beam of light includes a light pipe opening into said tube.

3. A sewing thread break indicator as set forth in claim 2 in which said photo amplifier includes a light source, and in which a second light pipe directs light from said light source to an opening in said thread accommodating tube adjacent to the opening into said thread accommodating tube for said light pipe transmitting a beam of light to the input of said photo amplifier.

4. A sewing thread break indicator as set forth in claim 2 in which said means responsive to uniformity in the output of said photo amplifier for signaling breakage of said sewing thread comprises a one-shot having an input responsive to the output of said photo amplifier, said one-shot providing a low value output in response to uniformity in the value of said input and a high value pulse of limited duration only in response to each predetermined change in the value of said input, and a signal generating means responsive to a low value output of said one-shot.

5. A sewing thread break indicator as set forth in claim 4 including means for rendering said signal generating means responsive to a low value output of said one-shot only during periods of operation of said sewing machine.

* * * * *